US010389050B2

(12) United States Patent
Huang et al.

(10) Patent No.: US 10,389,050 B2
(45) Date of Patent: Aug. 20, 2019

(54) ELECTRICAL CONNECTOR

(71) Applicant: LOTES CO., LTD, Keelung (TW)

(72) Inventors: Chang Wei Huang, Keelung (TW); Ted Ju, Keelung (TW); Zhi Yong Zhou, Keelung (TW); Yong Quan Wu, Keelung (TW); Zuo Feng Jin, Keelung (TW); Chien Chih Ho, Keelung (TW); Tung Ming Ho, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 15/974,856

(22) Filed: May 9, 2018

(65) Prior Publication Data

US 2018/0331442 A1 Nov. 15, 2018

Related U.S. Application Data

(60) Provisional application No. 62/505,206, filed on May 12, 2017.

(30) Foreign Application Priority Data

Aug. 10, 2017 (CN) ..... 2017 1 0678778
Sep. 15, 2017 (CN) ..... 2017 2 1184115 U
(Continued)

(51) Int. Cl.

| | |
|---|---|
| ***H01R 12/57*** | (2011.01) |
| ***H01R 12/58*** | (2011.01) |
| ***H01R 12/71*** | (2011.01) |
| ***H01R 13/24*** | (2006.01) |
| ***H01R 12/70*** | (2011.01) |

(52) U.S. Cl.
CPC ..... *H01R 12/585* (2013.01); *H01R 12/7076* (2013.01); *H01R 12/714* (2013.01); *H01R 13/2407* (2013.01); *H01R 12/57* (2013.01); *H01R 13/2442* (2013.01)

(58) Field of Classification Search
CPC ..... H01R 12/585; H01R 12/7076; H01R 12/714; H01R 13/2407; H01R 12/57; H01R 13/2442
See application file for complete search history.

(56) References Cited

U.S. PATENT DOCUMENTS 7,322,829 B2 * 1/2008 Ma ..... H01R 13/2442 439/66
7,390,195 B2 * 6/2008 Liao ..... H01R 13/2435 439/66
(Continued)

*Primary Examiner* — Truc T Nguyen
(74) *Attorney, Agent, or Firm* — Locke Lord LLP; Tim Tingkang Xia, Esq.

(57) ABSTRACT

An electrical connector configured to electrically connect to a chip module includes: a body, provided with at least one accommodating hole, where the body has a protruding block provided to protrude upward from one side of the accommodating hole, and the protruding block is configured to support the chip module upward; and at least one terminal, correspondingly accommodated in the at least one accommodating hole. The terminal includes a base, accommodated in the accommodating hole; an elastic arm, formed by extending forward from the base, located at one side of the protruding block, and configured to be electrically connected with the chip module; and a through slot, running vertically through the elastic arm. The protruding block has a rear end. The base is located behind the rear end, and the through slot extends forward beyond the rear end.

21 Claims, 14 Drawing Sheets

(30) Foreign Application Priority Data

| | | |
|---|---|---|
| Dec. 1, 2017 | (CN) | 2017 1 1250191 |
| Dec. 1, 2017 | (CN) | 2017 1 1251160 |
| Dec. 1, 2017 | (CN) | 2017 2 1652834 U |
| Dec. 19, 2017 | (CN) | 2017 1 1370067 |
| Jan. 12, 2018 | (CN) | 2018 1 0029591 |
| Mar. 12, 2018 | (CN) | 2018 1 0199198 |
| Apr. 13, 2018 | (CN) | 2018 1 0330237 |

(56) References Cited

U.S. PATENT DOCUMENTS

| | | | | |
|---|---|---|---|---|
| 7,427,203 | B2 * | 9/2008 | Liao | H01R 12/57 439/66 |
| 7,435,100 | B2 * | 10/2008 | Chang | H01R 13/2435 439/66 |
| 8,323,038 | B2 * | 12/2012 | Jin | H01R 12/714 439/66 |
| 8,535,093 | B1 * | 9/2013 | Mason | H01R 13/6585 439/607.05 |
| 8,851,904 | B2 * | 10/2014 | Chang | H01R 12/71 439/607.03 |
| 2004/0132319 | A1 * | 7/2004 | Richter | H01R 13/2435 439/66 |
| 2005/0020098 | A1 * | 1/2005 | Ramey | H01R 13/2442 439/66 |
| 2006/0040518 | A1 * | 2/2006 | Ma | H01R 13/2442 439/66 |
| 2008/0200042 | A1 * | 8/2008 | McAlonis | H01R 13/2442 439/66 |
| 2014/0162472 | A1 * | 6/2014 | Walden | H01R 12/714 439/66 |

* cited by examiner

2

ELECTRICAL CONNECTOR

CROSS-REFERENCE TO RELATED PATENT APPLICATION

This non-provisional application claims priority to and the benefit of, under 35 U.S.C. § 119(e), U.S. provisional patent application Ser. No. 62/505,206, filed May 12, 2017, and under 35 U.S.C. § 119(a), patent application Serial No. CN201710678778.1 filed in China on Aug. 10, 2017; patent application Serial No. CN201721184115.6 filed in China on Sep. 15, 2017; patent application Serial No. CN201711251160.3 filed in China on Dec. 1, 2017; patent application Serial No. CN201721652834.6 filed in China on Dec. 1, 2017; patent application Serial No. CN201711250191.7 filed in China on Dec. 1, 2017; patent application Serial No. CN201711370067.4 filed in China on Dec. 19, 2017; patent application Serial No. CN201810029591.3 filed in China on Jan. 12, 2018; patent application Serial No. CN201810199198.9 filed in China on Mar. 12, 2018; and patent application Serial No. CN201810330237.4 filed in China on Apr. 13, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector used for electrically connecting a chip module.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Generally, a chip module is electrically connected with a circuit board through an electrical connector. The electrical connector has an insulating body and multiple conductive terminals installed on the insulating body, and the conductive terminal has a tail portion connected with the circuit board and an elastic arm connected with the chip module that can be elastically deformed. With the continuous development of technology, the arrangement density of the conductive terminals on the electrical connector is continuously increasing. Meanwhile, the height of the electrical connector is reduced to satisfy the thinning demand.

Under normal circumstances, to achieve a good electrical connection between the conductive terminals and the chip module, a stable contact between the conductive terminals and the chip module is required. Thus, the elasticity of the elastic arm must be increased accordingly. A common design is to lengthen the elastic arm to obtain better elasticity, so as to ensure the stable contact between the conductive terminals and the chip module. However, in such structure, during the process that the chip module presses the elastic arm for a long time, the elastic arm is prone to fatigue, such that a stable electrical contact between the conductive terminal and the chip module cannot be ensured, and the height of the conductive terminal cannot be effectively reduced. Therefore, the demand of thinning of the electrical connector cannot be satisfied. Meanwhile, in the increasing trend of the arrangement density of the conductive terminals, short circuiting easily occurs between the longer elastic arms. In addition, to reduce the height of the conductive terminals and ensure that the elastic arm has sufficient elasticity, the longer elastic arm needs to be bent multiple times, which leads to a very complicated manufacturing process of the conductive terminal.

Therefore, a heretofore unaddressed need to design a novel electrical connector exists in the art to address the aforementioned deficiencies and inadequacies.

SUMMARY

The present invention aims on providing an electrical connector which ensures that the terminal has favorable elasticity and satisfies the thinning demand.

To achieve the foregoing objective, the present invention adopts the following technical solutions.

An electrical connector, configured to electrically connect to a chip module, includes: a body, provided with at least one accommodating hole, wherein the body has a protruding block provided to protrude upward from one side of the accommodating hole, and the protruding block is configured to support the chip module upward; and at least one terminal, correspondingly accommodated in the at least one accommodating hole, wherein the terminal includes: a base, accommodated in the accommodating hole; an elastic arm, formed by extending forward from the base, located at one side of the protruding block, and configured to be electrically connected with the chip module; and a through slot, running vertically through the elastic arm, wherein the protruding block has a rear end, the base is located behind the rear end, and the through slot extends forward beyond the rear end.

In certain embodiments, the through slot is provided not to have an identical width in an extending direction thereof.

In certain embodiments, the body is provided with a plurality of accommodating holes and a plurality of protruding blocks, one side of each of the accommodating holes is provided with one of the protruding blocks, the protruding block is located between the two adjacent accommodating holes, the protruding block has a front end provided to be opposite to the rear end, and the front end is flush with another side of one of the accommodating holes.

In certain embodiments, the body is provided with a plurality of accommodating holes and a plurality of protruding blocks, one side of each of the accommodating holes is provided with one of the protruding blocks, each of a left side and a right side of the elastic arm is respectively provided with one of the protruding blocks, and when the elastic arm is deflected by an external force in a left-right direction, the elastic arm laterally abuts one of the protruding blocks.

In certain embodiments, the protruding block has a front end provided to be opposite to the rear end, and the through slot has a front edge located between the front end and the rear end.

In certain embodiments, when the chip module completely presses the elastic arm, the chip module downward abuts the protruding block, and the front edge is located forward beyond the front end.

In certain embodiments, the terminal includes an engaging portion formed by bending and extending from one side of the base, the protruding block has a front end provided to be opposite to the rear end, and the engaging portion is accommodated in the accommodating hole and located behind the front end.

In certain embodiments, the engaging portion is located behind the rear end.

In certain embodiments, the engaging portion is perpendicular to the base and forms an interference fit with an inner wall surface of the accommodating hole.

In certain embodiments, the terminal includes a strip connecting portion formed by extending upward from the engaging portion, and the strip connecting portion is configured to be connected with a strip and located behind the rear end.

In certain embodiments, the terminal includes a position limiting portion formed by extending outward from the base, the accommodating hole is provided with a position limiting surface located below the position limiting portion and configured to limit the terminal from moving downward, and the position limiting portion and the protruding block are located respectively at a left side and a right side of the through slot.

In certain embodiments, the terminal includes a conducting portion formed by extending downward from the base, the conducting portion is configured to conduct a circuit board, the conducting portion comprises an extending portion formed by extending downward from the base and a stopping portion formed by extending from one side of the extending portion, and an inner wall surface of the accommodating hole is protrudingly provided with a stopping block located above the stopping portion and configured to limit the terminal from moving upward.

In certain embodiments, the terminal includes a conducting portion extending downward from the base, the conducting portion is configured to conduct a circuit board, the conducting portion comprises an extending portion formed by extending downward from the base and a bending portion formed by bending and extending from one side of the extending portion, the body is provided with a position limiting block at another side of the accommodating hole, the extending portion and the bending portion are in contact with a solder material, and the position limiting block limits a position of the solder material, such that the solder material is accommodated in a space defined by the extending portion, the bending portion and the position limiting block.

In certain embodiments, a tail end of the elastic arm is provided with a contact portion configured to abut the chip module, and a lowest point of a tail end of the contact portion is located above the through slot.

In certain embodiments, the contact portion is arc-shaped and defines a center of a circle, and the lowest point of the tail end of the contact portion is located below the center of the circle.

In certain embodiments, the elastic arm includes a first arm formed by extending upward from the base, a second arm formed by bending and extending upward and forward from the first arm, and a contact portion formed by bending and extending upward and forward from the second arm, wherein the contact portion is configured to abut the chip module, and a width of a connecting portion connecting the first arm to the second arm is greater than a width of a connecting portion connecting the second arm to the contact portion.

In certain embodiments, the through slot runs vertically through the second arm, and at least extends downward to the connecting portion connecting the first arm to the second arm.

In certain embodiments, the base has a vertical plane, the first arm is formed by bending and extending upward from the base in a direction away from the vertical plane, and the second arm is formed by bending and extending reversely from the first arm to pass beyond the vertical plane.

In certain embodiments, the protruding block has a front end provided to be opposite to the rear end, a width of the rear end in a left-right direction is less than a width of the front end in the left-right direction, the second arm extends forward beyond the front end from behind the rear end, and a width of the second arm gradually decreases in an extending direction thereof.

In certain embodiments, the through slot does not run forward through an extended tail end of the elastic arm.

In certain embodiments, a tail end of the elastic arm is provided with a contact portion configured to abut the chip module, and the through slot extends forward to the contact portion.

Compared with the related art, the electrical connector according to certain embodiments of the present invention has the following beneficial effects.

The through slot runs vertically through the elastic arm and extends forward beyond the rear end, such that the arrangement of the through slot can effectively increase the elasticity of the elastic arm on the premise of ensuring that a length of the elastic arm is unchanged, thereby ensuring the stable contact between the elastic arm and the chip module, which does not easily fatigue, and satisfying the demand of thinning of the electrical connector. When the chip module downward abuts the elastic arm, the elastic arm forms two parallel conductive paths at two opposite sides of the through slot, thereby enhancing the high-frequency signal transmitting capacity of the terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
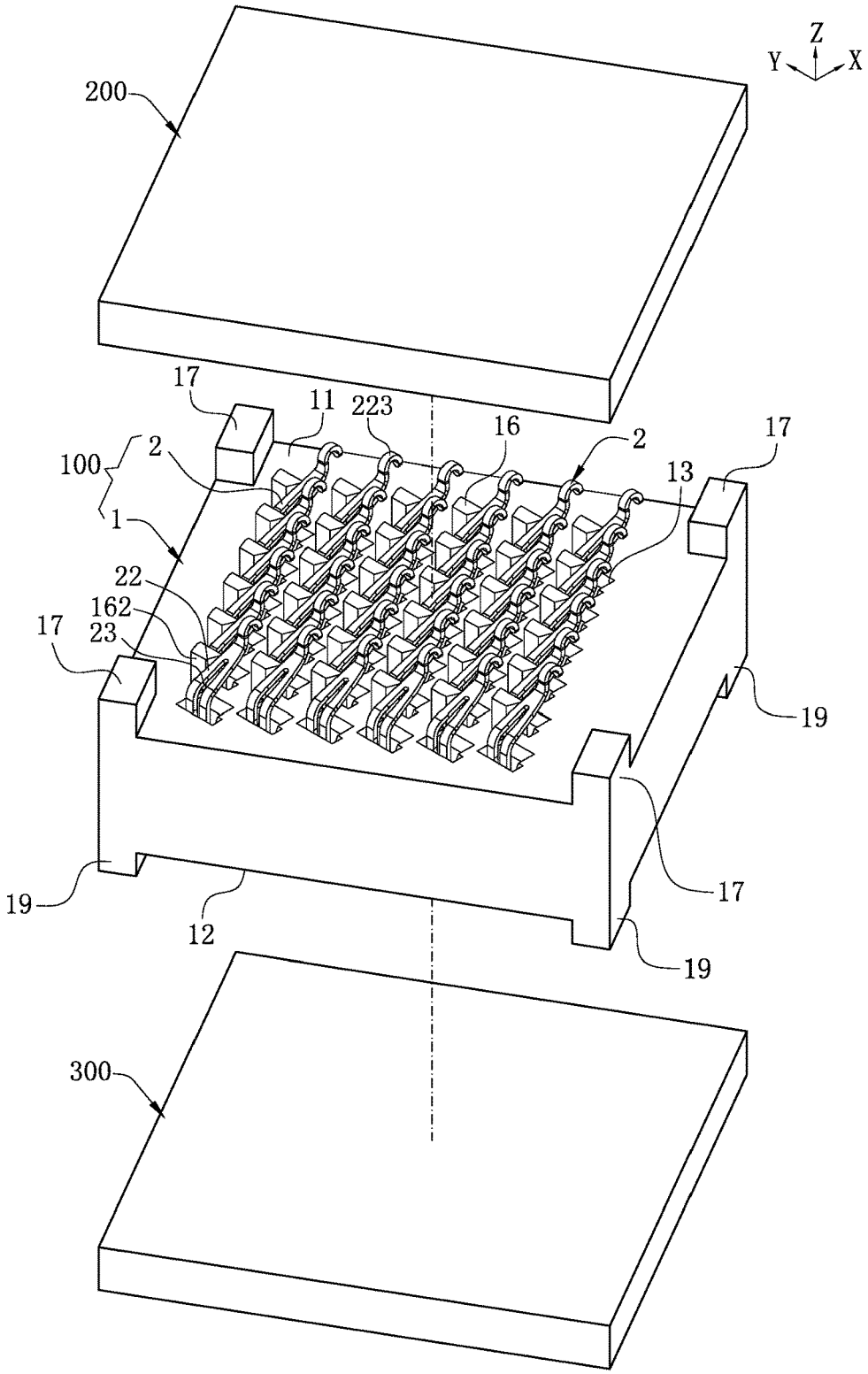
FIG. 1 is a perspective view of an electrical connector, a chip module and a circuit board according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector.

As shown in FIG. 1, a front-rear direction X, a left-right direction Y and a vertical direction Z which are perpendicular to the front-rear direction X are defined for the electrical connector 100 of the present invention.

As shown in FIG. 1, the electrical connector 100 according to the first embodiment of the present invention is used for electrically connecting a chip module 200 to a circuit board 300, and includes a body 1 for supporting the chip module 200 upward and multiple terminals 2 accommodated in the body 1.

As shown in FIG. 1, in this embodiment, the body 1 is made of an insulating material. In other embodiments, the body 1 may also be made of other materials which cannot cause electrical conduction with the terminals 2 but have the function of shielding the terminals 2. The body 1 has an upper surface 11 and a lower surface 12 opposite to each other; and the body 1 is provided with multiple accommodating holes 13 which run vertically through the upper surface 11 and the lower surface 12. In other embodiments, when there is only one terminal 2, there is also only one accommodating hole 13.

Figure 5:
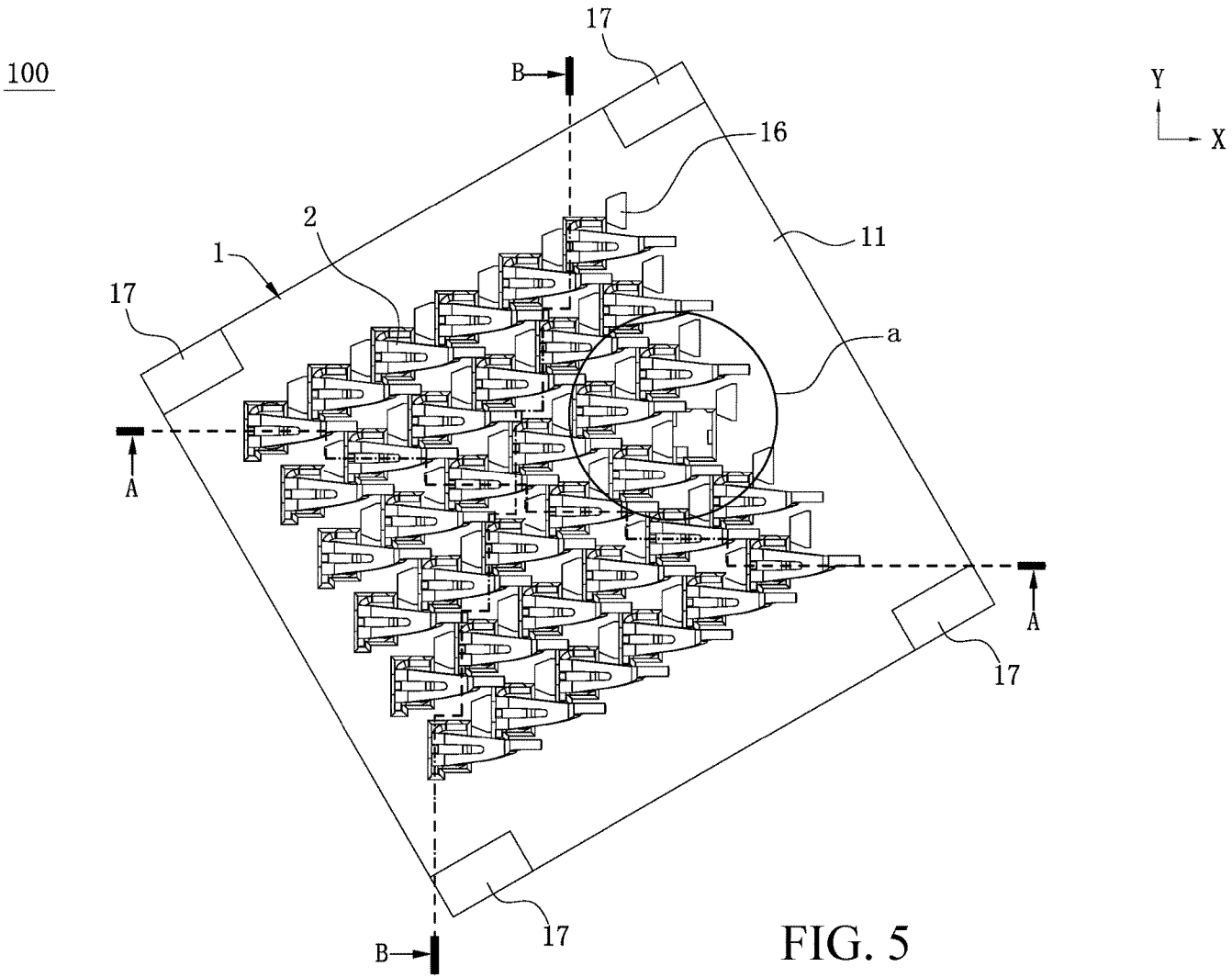
FIG. 5 is a top view of the electrical connector in FIG. 1.
Figure 6:
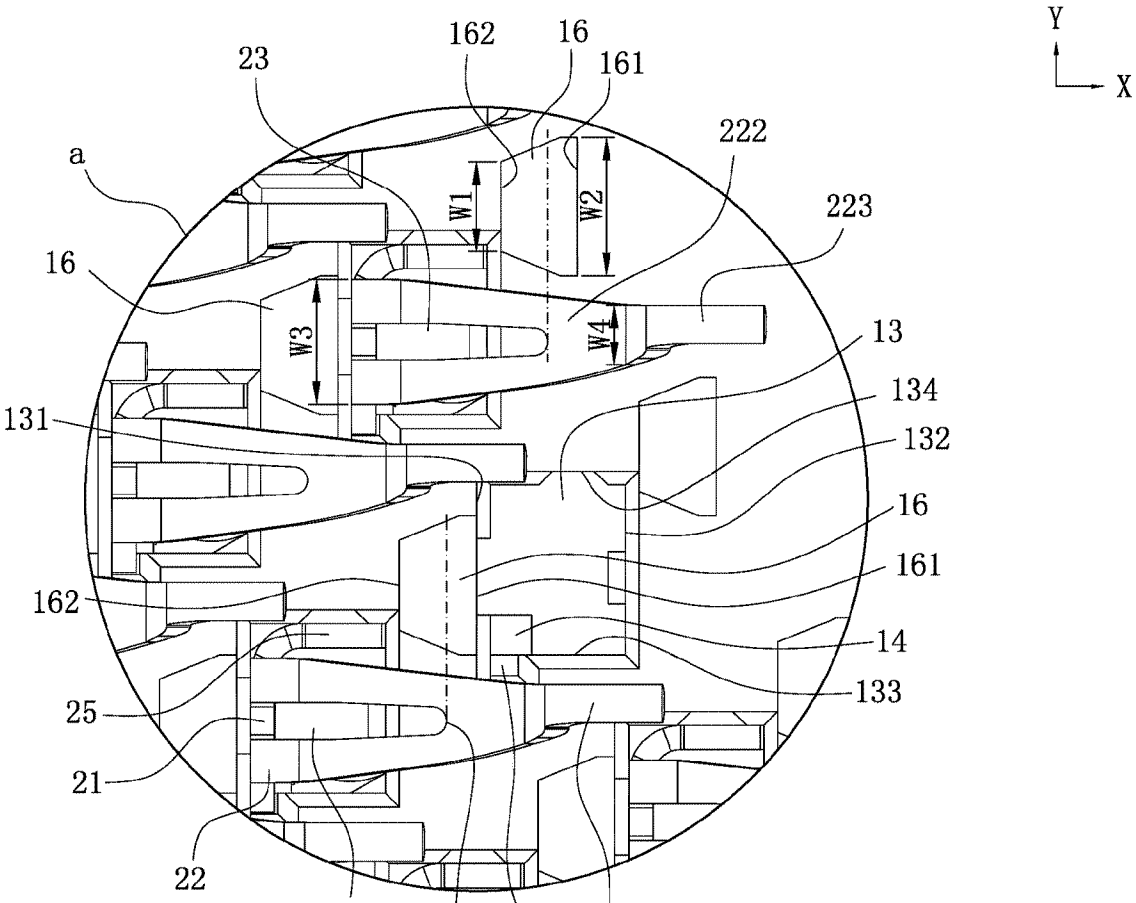
FIG. 6 is an enlarged view of a part a of the electrical connector in FIG. 5.
Figure 9:
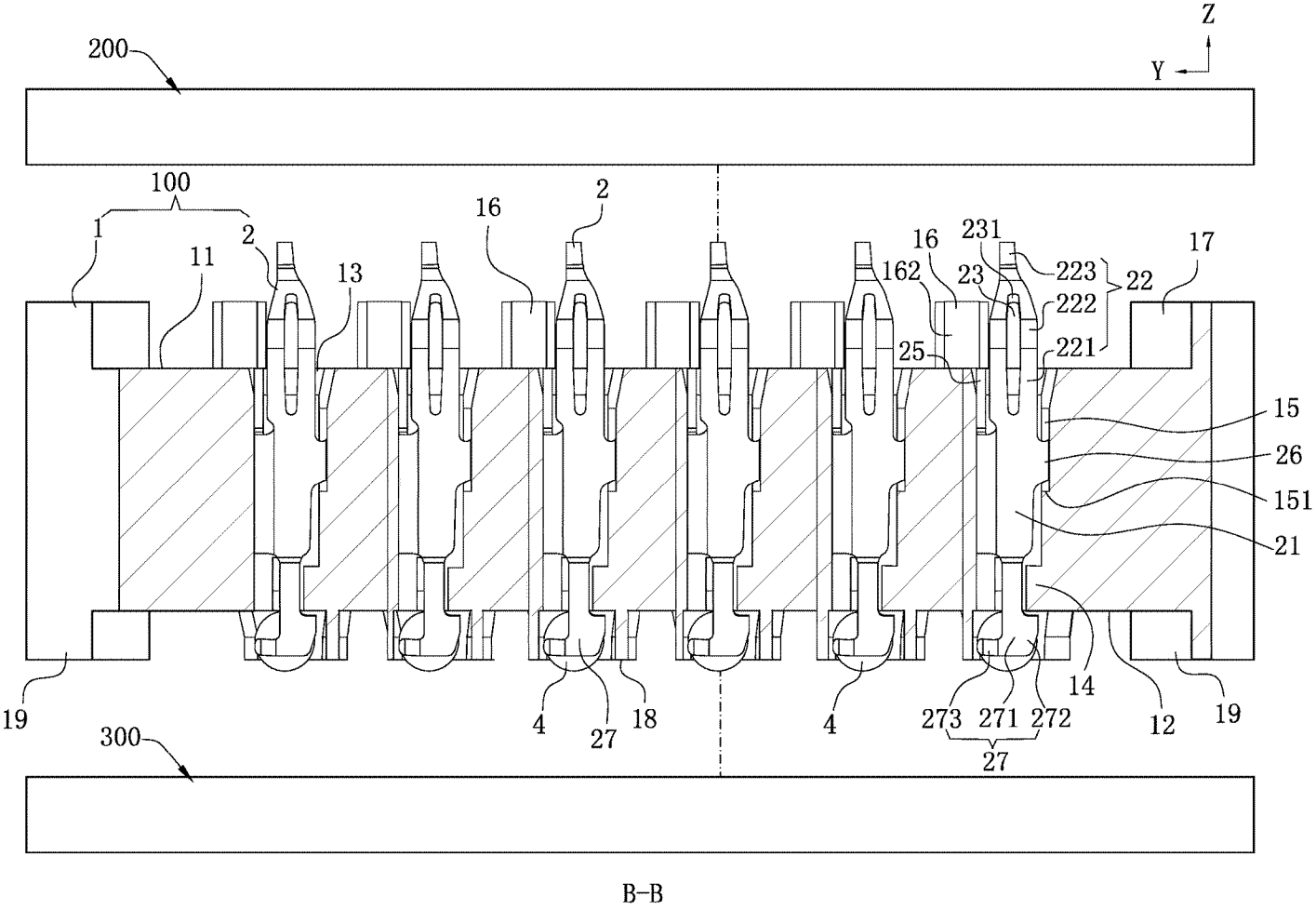
FIG. 9 is a sectional view of the electrical connector in FIG. 5 in the B-B direction before the chip module presses downward.
Figure 10:
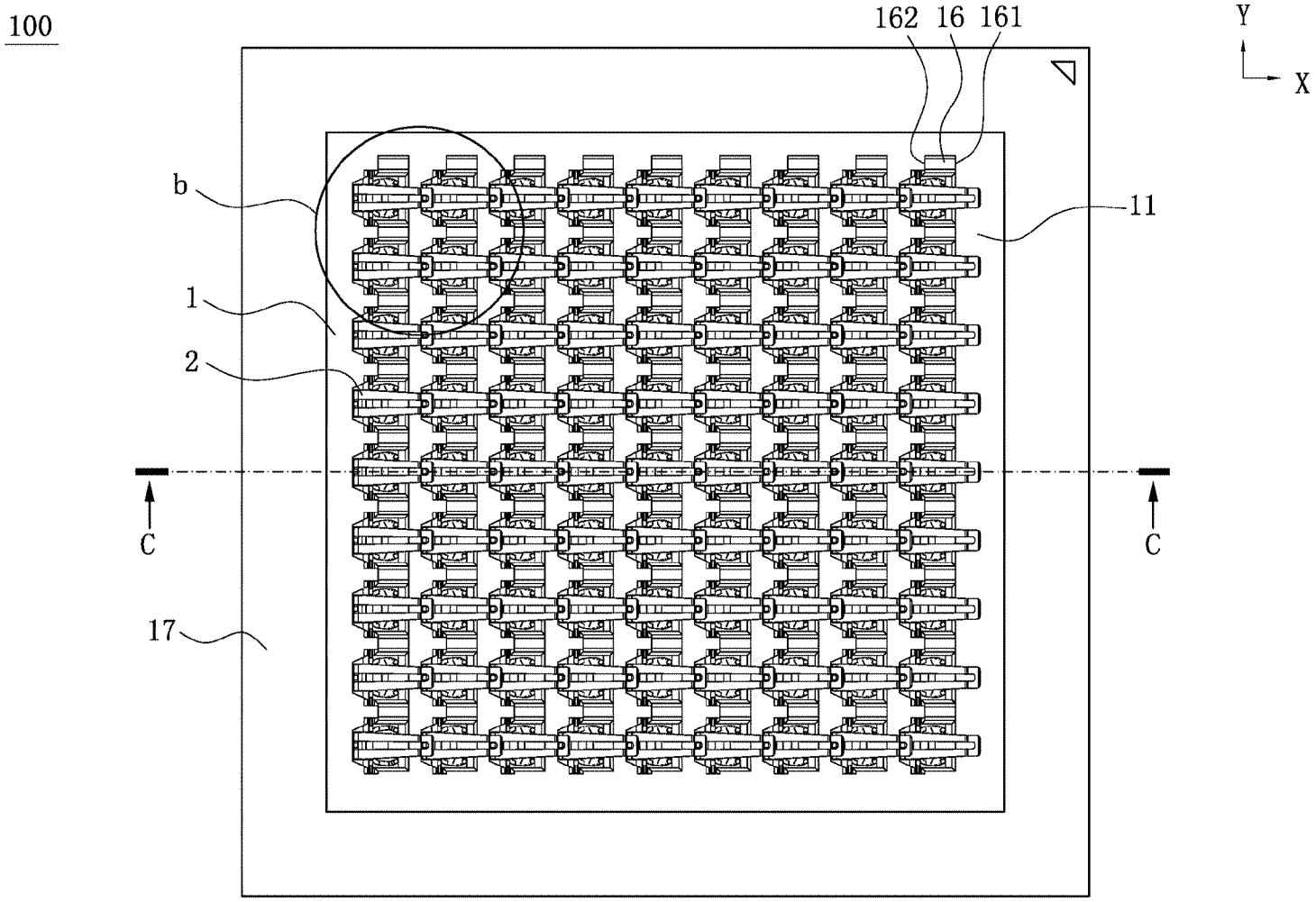
FIG. 10 is a top view of an electrical connector according to a second embodiment of the present invention.
Figure 11:
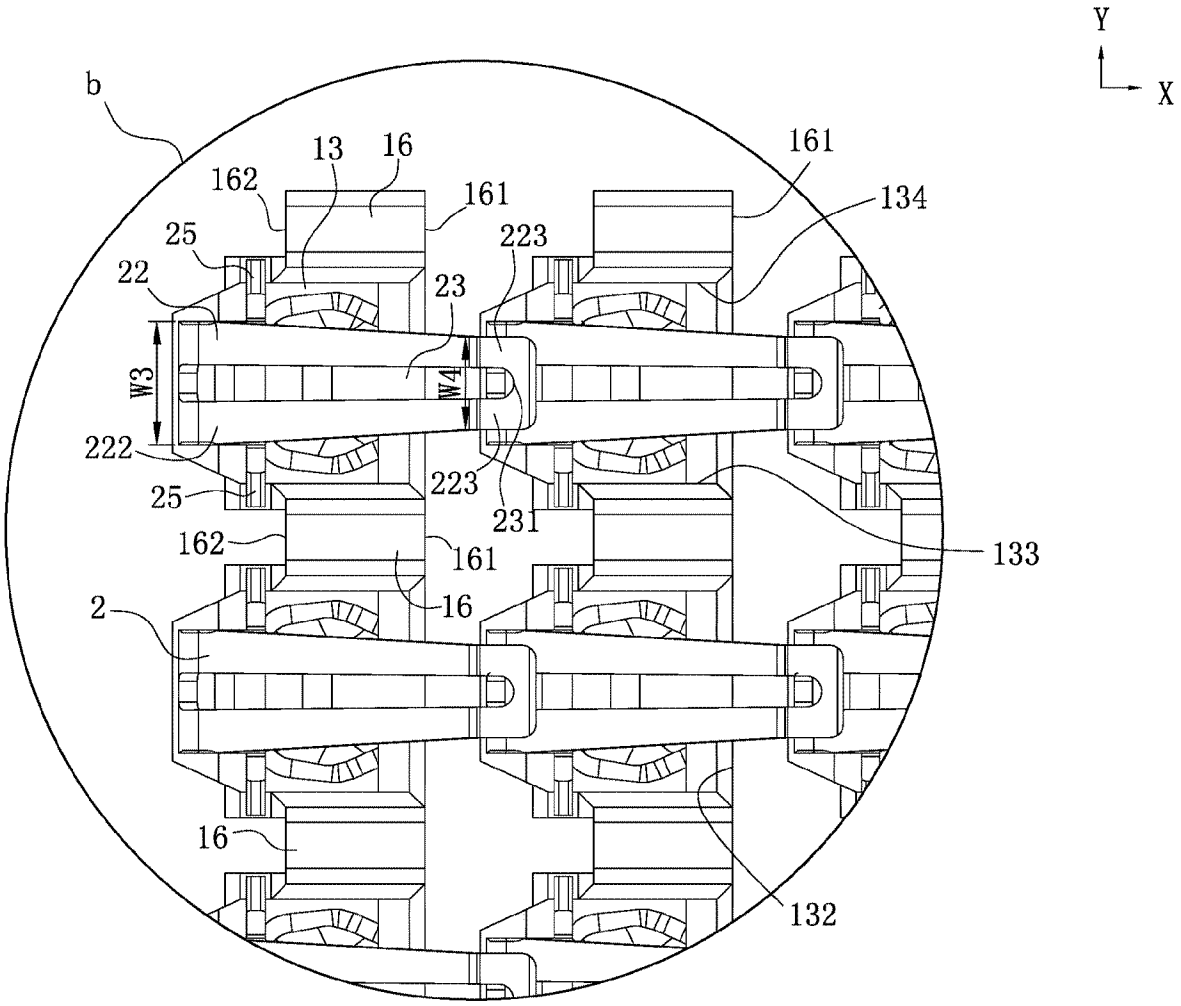
FIG. 11 is an enlarged view of a part b of the electrical connector in FIG. 10.
Figure 12:
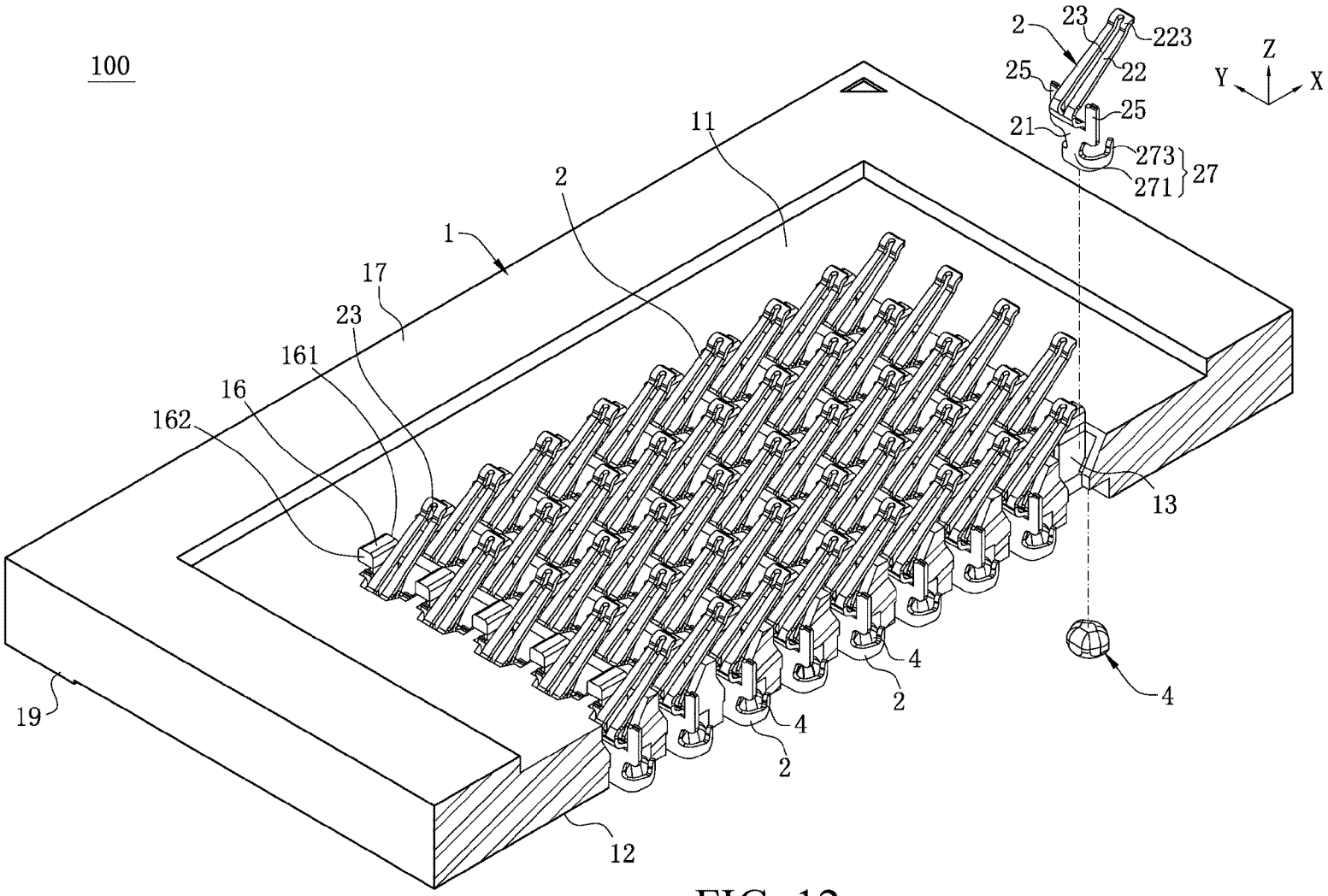
FIG. 12 is a perspective sectional view of the electrical connector in FIG. 10 in the C-C direction.
Figure 13:
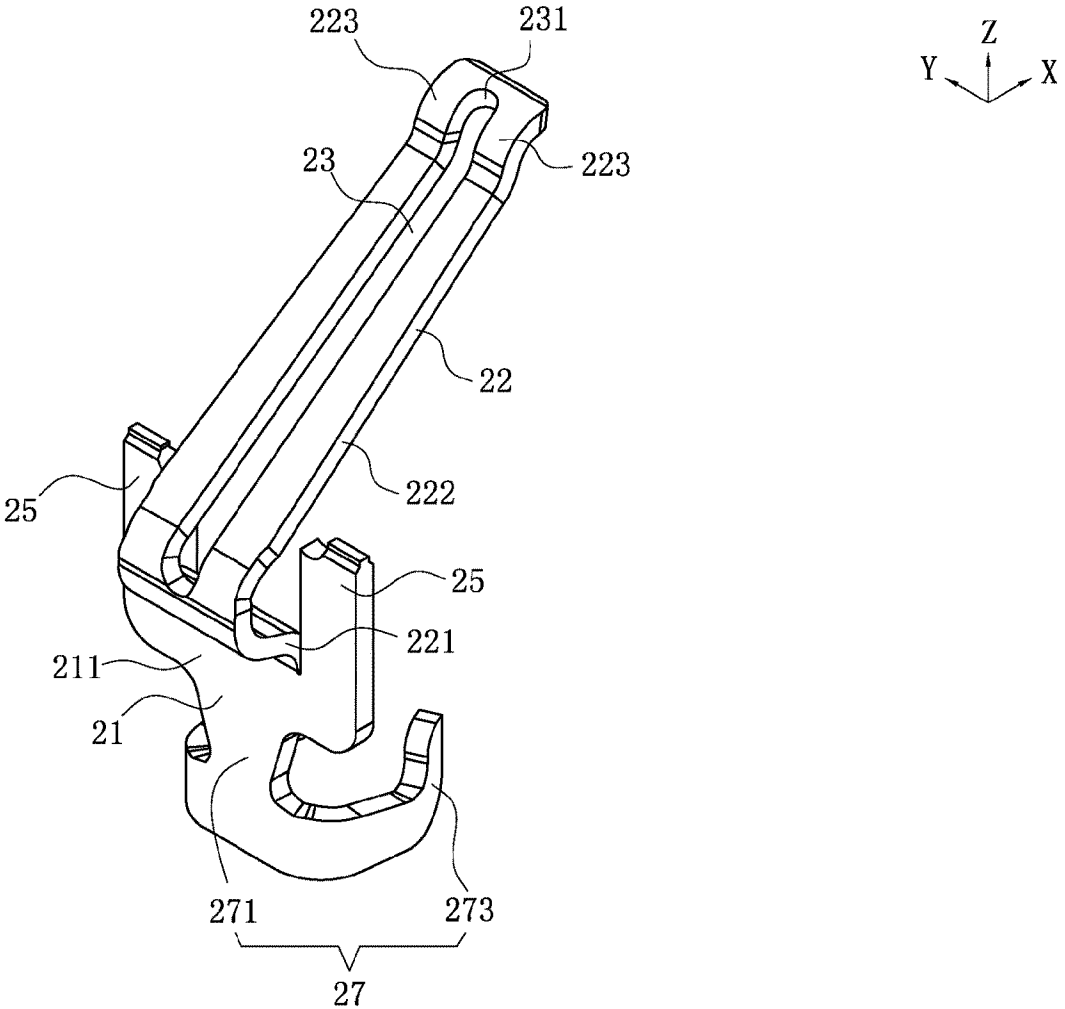
FIG. 13 is a perspective view of a terminal of the electrical connector in FIG. 12.
Figure 14:
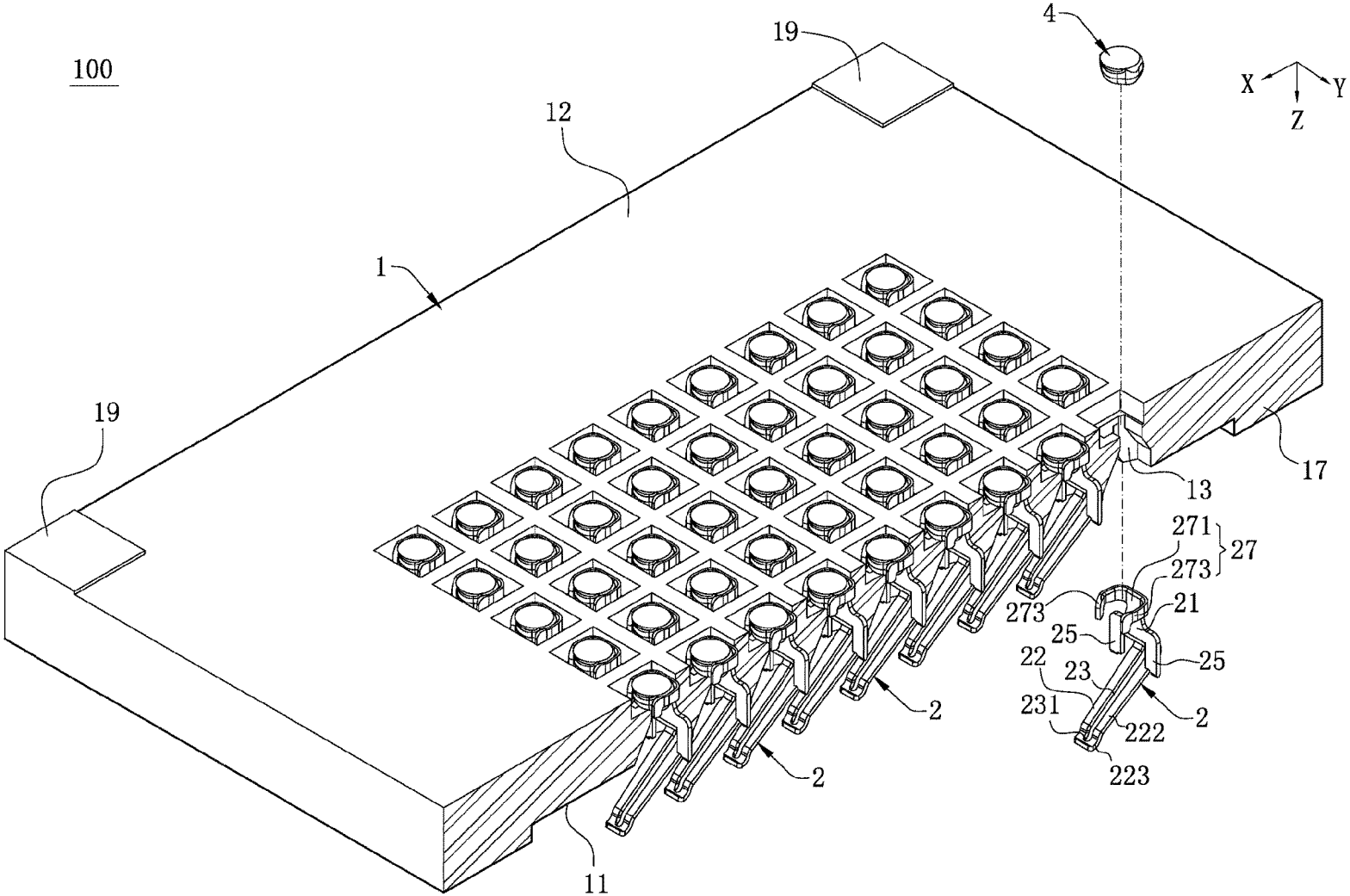
FIG. 14 is a perspective view of the electrical connector in FIG. 13 being inverted by 180 degrees.

As shown in FIG. 5, FIG. 6 and FIG. 9, each of the accommodating holes 13 has a first wall surface 131 and a second wall surface 132 opposite to each other in the front-rear direction X, and a third wall surface 133 and a fourth wall surface 134 which are connected with the first wall surface 131 and the second wall surface 132. The third wall surface 133 and the fourth wall surface 134 are opposite to each other in the left-right direction Y. The first wall surface 131 is located behind the second wall surface 132, and the fourth wall surface 134 is positioned on the left side of the third wall surface 133. The first wall surface 131 protrudingly extends toward the second wall surface 132 to form a stopping block 14. The stopping block 14 is connected with the third wall surface 133. The accommodating hole 13 has an accommodating groove 15 concavely formed from the third wall surface 133, and the bottom of the accommodating groove 15 has a position limiting surface 151. The position limiting surface 151 is located above the stopping block 14.

Figure 2:
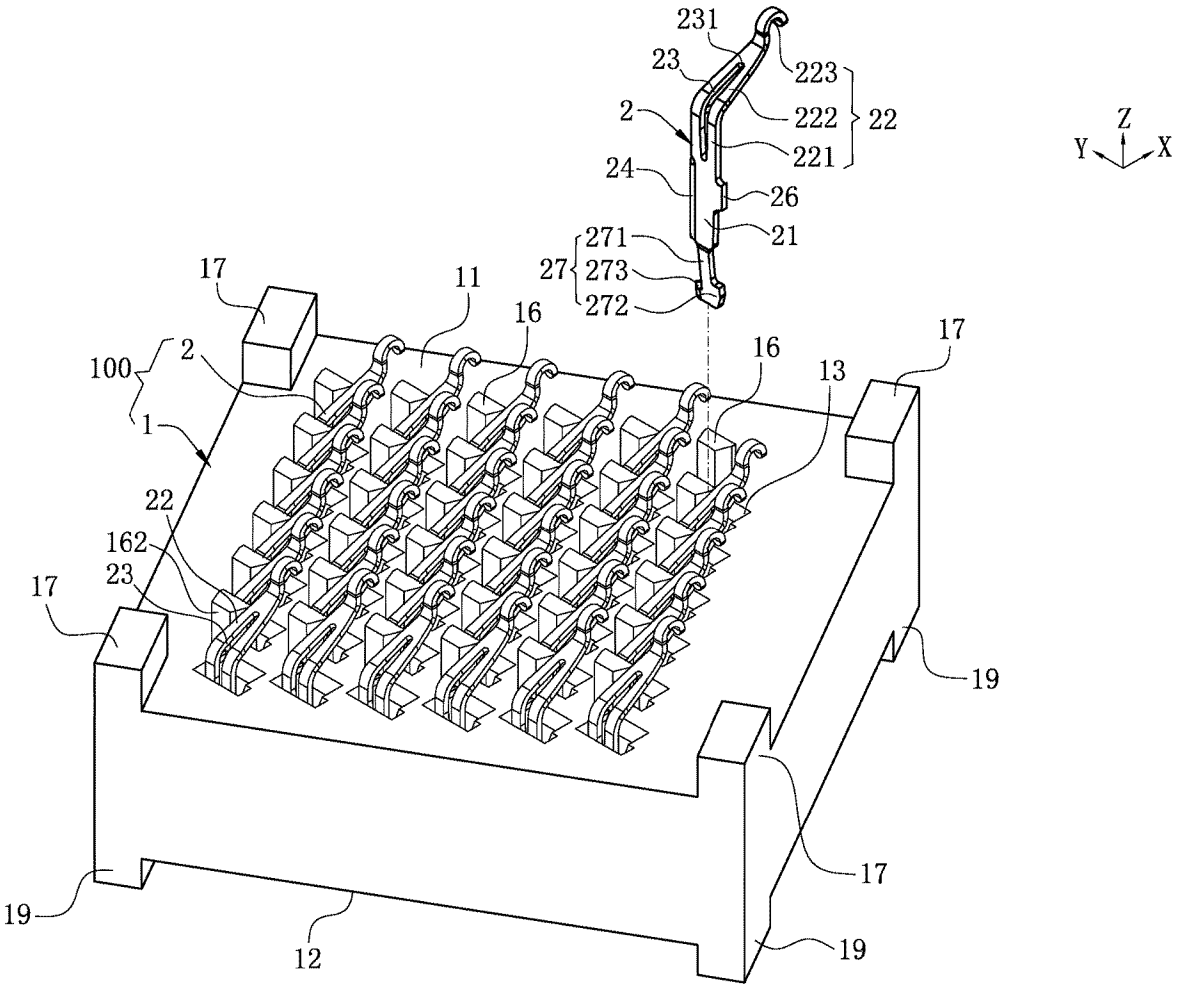
FIG. 2 is a perspective exploded view of the electrical connector in FIG. 1.

As shown in FIG. 2, FIG. 5 and FIG. 6, the body 1 is provided with one protruding block 16 at one side of each of the accommodating holes 13. The protruding block 16 is formed by extending upward from the upper surface 11 and used for supporting the chip module 200 upward. The protruding block 16 is located in front of the corresponding accommodating hole 13 and provided to be adjacent to the fourth wall surface 134, and the protruding block 16 is located between the two adjacent accommodating holes 13 in the front-rear direction X. The protruding block 16 has a front end 161 and a rear end 162 which are opposite to each other. The front end 161 and the rear end 162 are parallel, and a width W1 of the rear end 162 in the left-right direction Y is less than a width W2 of the front end 161 in the left-right direction Y. The front end 161 is flush with the first wall surface 131 of one of the accommodating holes 13 located in front thereof, so as to increase the strength of the protruding block 16. The rear end 162 is flush with the second wall surface 132 of the corresponding accommodating hole 13.

Figure 7:
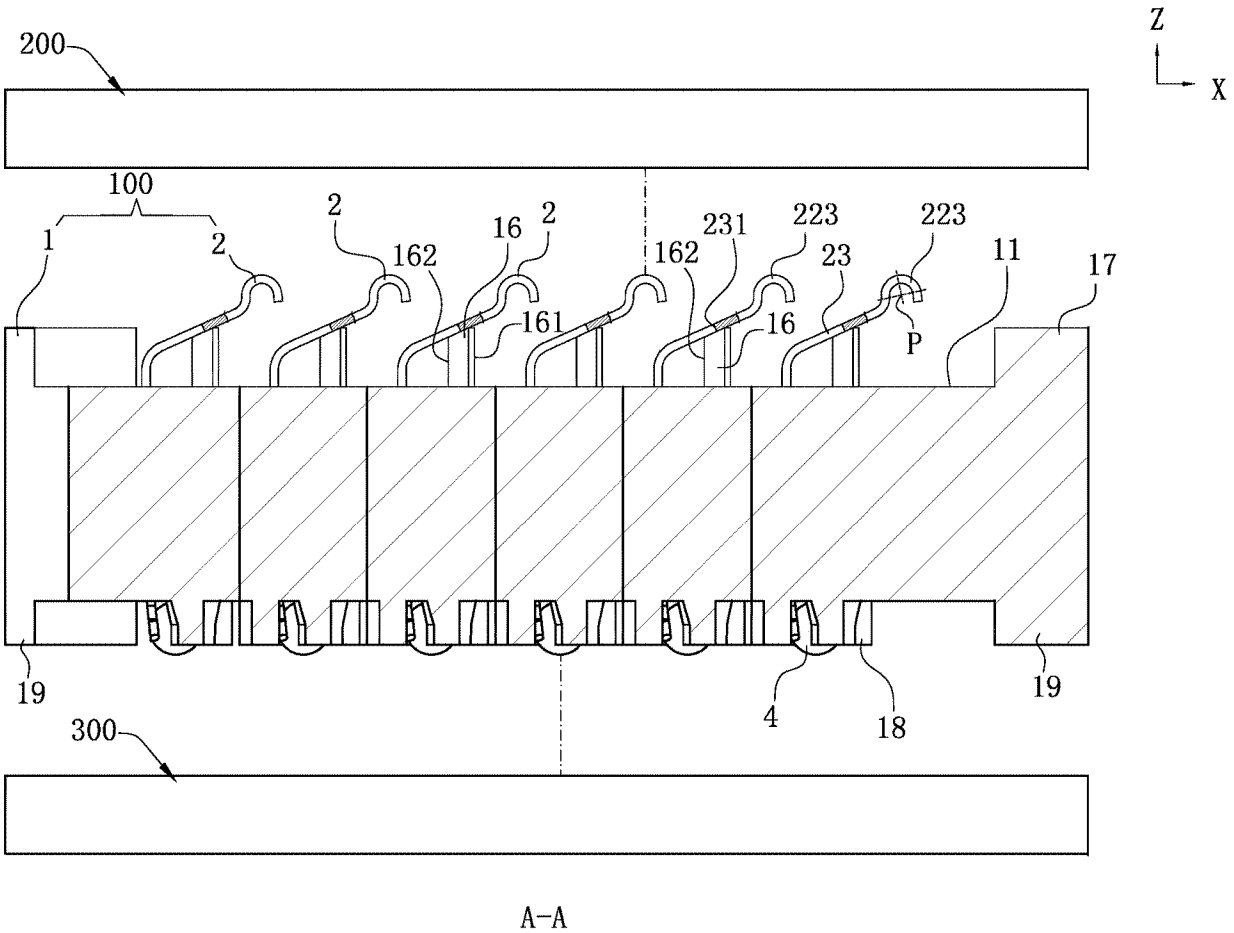
FIG. 7 is a sectional view of the electrical connector in FIG. 5 in the A-A direction before the chip module presses downward.
Figure 8:
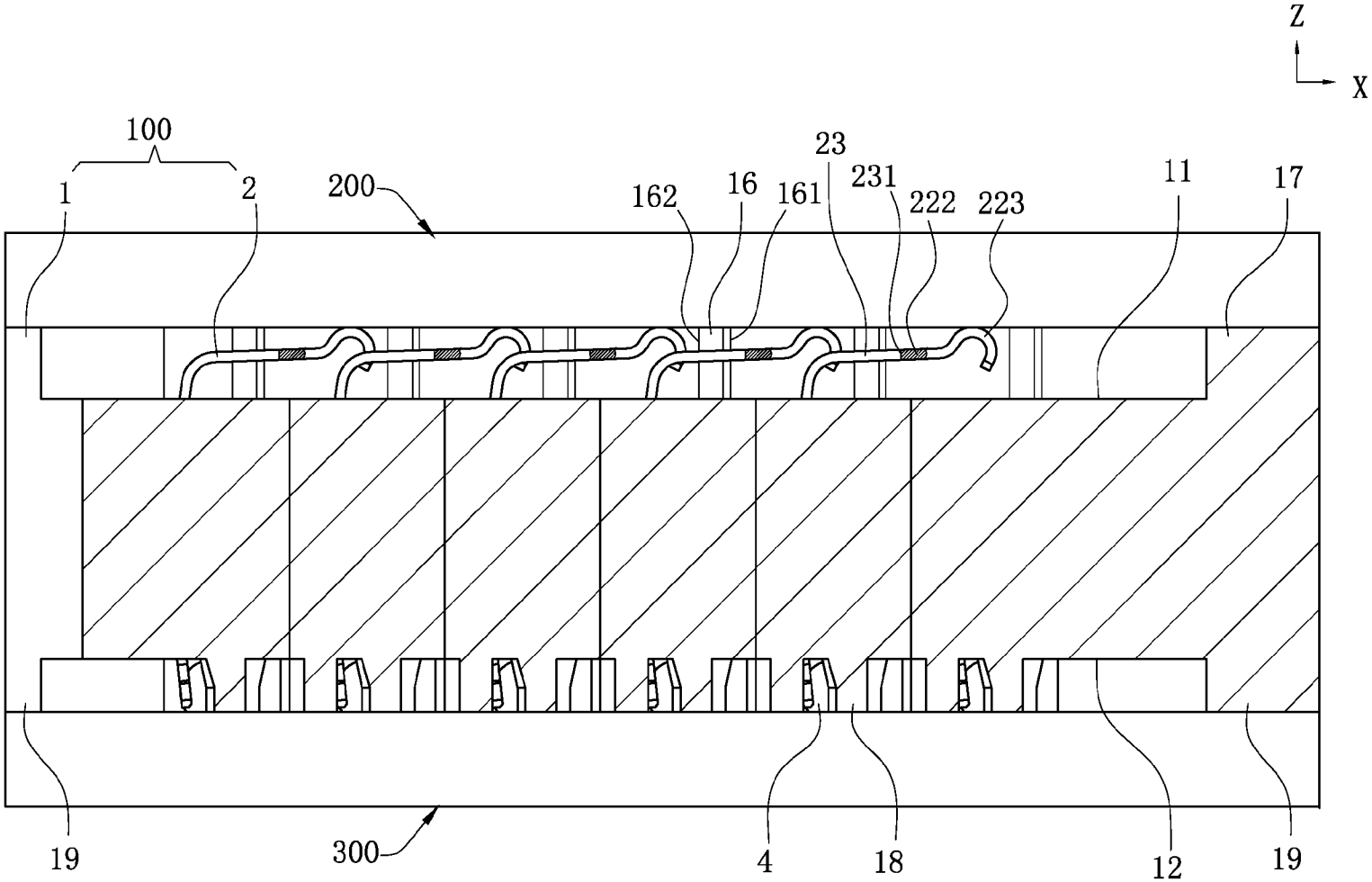
FIG. 8 is a sectional view of the electrical connector in FIG. 7 being installed on the circuit board after the chip module presses downward.

As shown in FIG. 2, FIG. 7 and FIG. 8, the upper surface 11 protrudingly extends upward to form four protruding portions 17, and the four protruding portions 17 are respectively located at the four corners of the body 1. The top surface of each of the protruding portions 17 is flush with the top surface of the protruding block 16, and the protruding portions 17 are used for supporting the chip module 200 upward.

Figure 4:
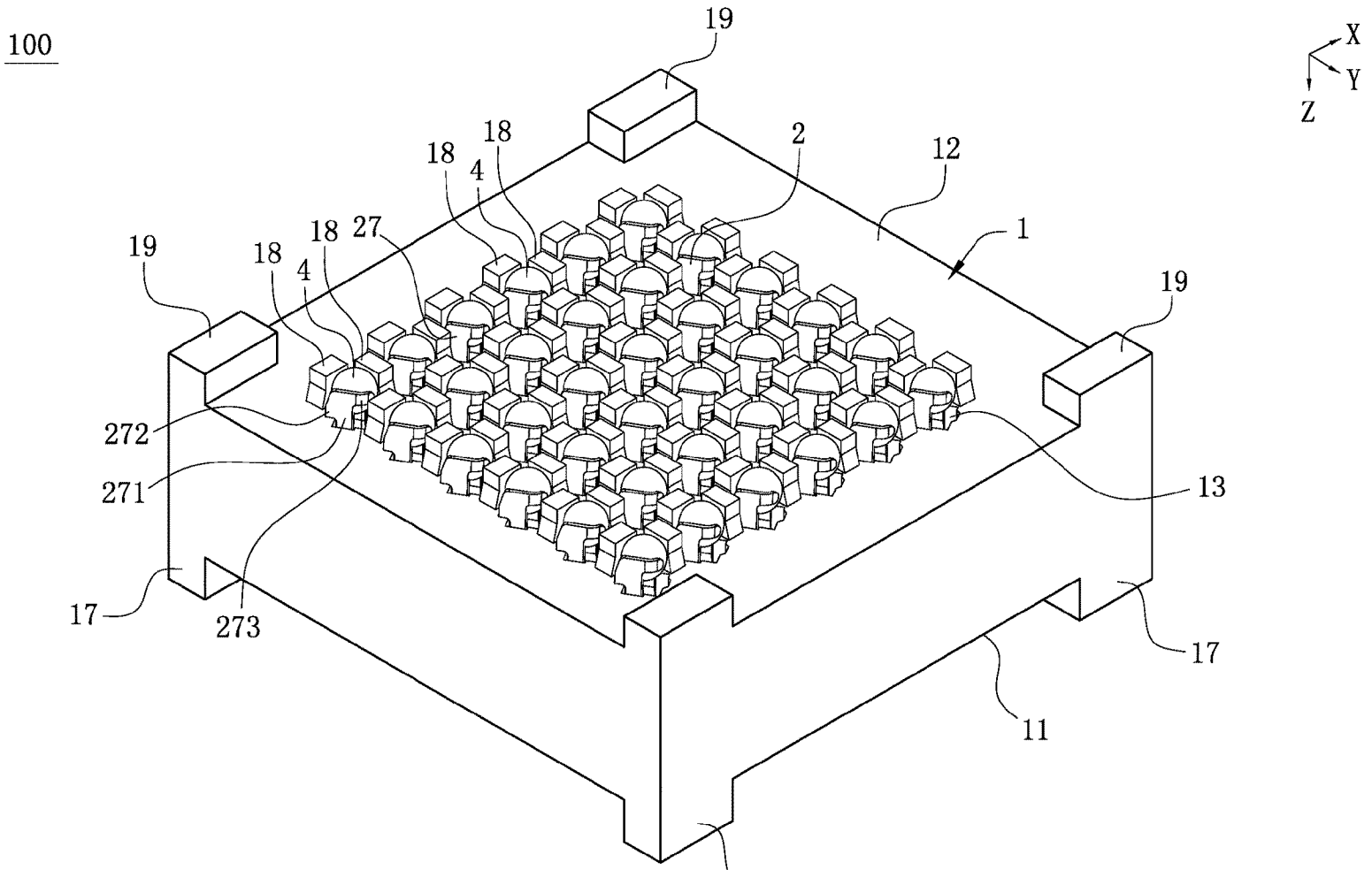
FIG. 4 is a perspective view of the electrical connector in FIG. 1 being inverted by 180 degrees.

As shown in FIG. 4, FIG. 7 and FIG. 8, the lower surface 12 protrudingly extends downward to form multiple position limiting blocks 18. A periphery of each of the accommodating holes 13 is correspondingly provided with two of the position limiting blocks 18. When the electrical connector 100 is installed on the circuit board 300, the position limiting blocks 18 downward abut the circuit board 300.

The lower surface 12 protrudingly extends downward to form four standing legs 19, and the four standing legs 19 are respectively located at the four corners of the body 1. The bottom surface of each of the standing legs 19 is flush with the bottom surface of each of the position limiting blocks 18. The standing legs 19 and the protruding portions 17 are correspondingly arranged vertically. When the electrical connector 100 is installed on the circuit board 300, the standing legs 19 downward abut the circuit board 300.

As shown in FIG. 2, the terminals 2 are correspondingly accommodated in the accommodating holes 13 respectively.

Figure 3:
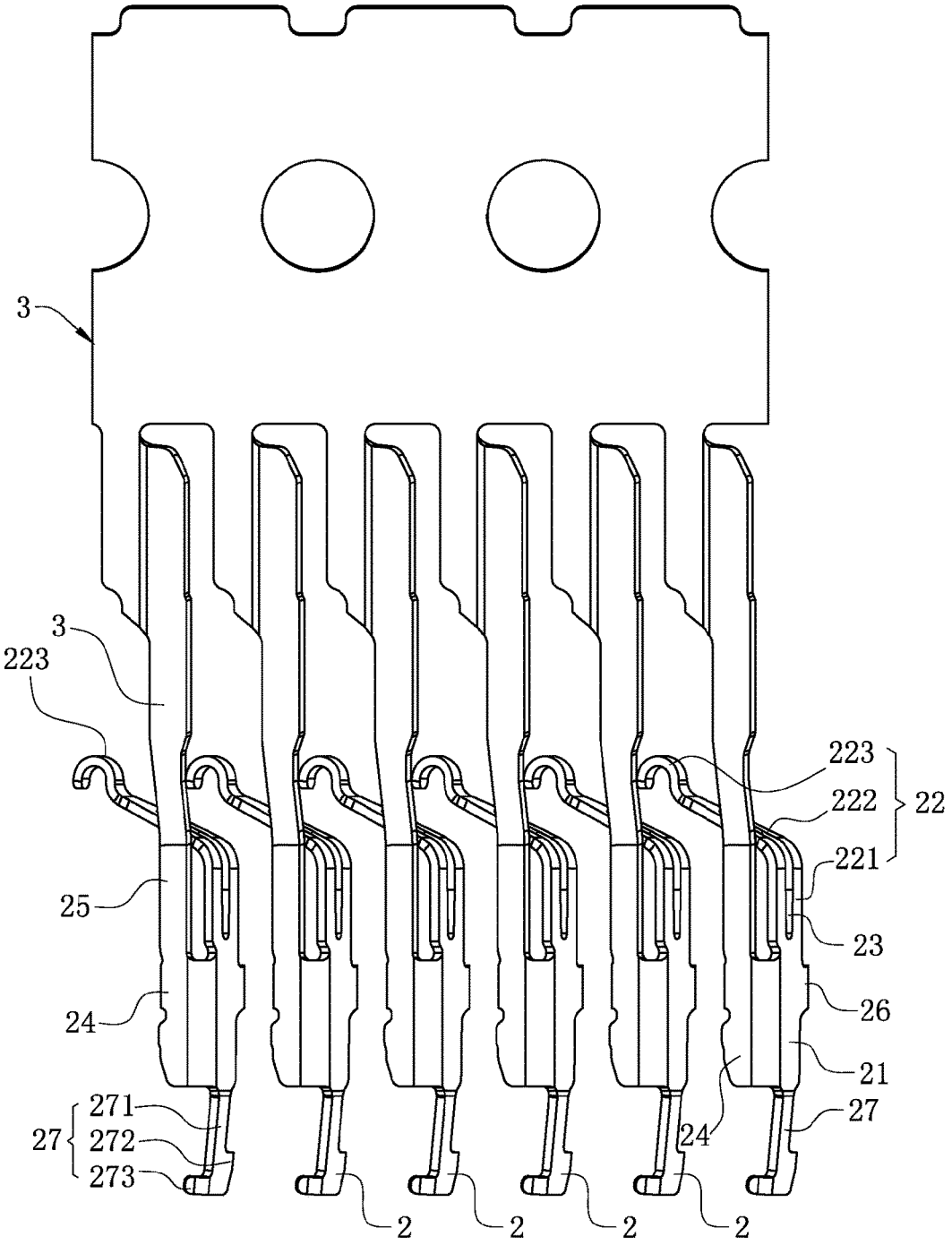
FIG. 3 is a perspective view of a terminal of the electrical connector in FIG. 2 being connected with a strip.

As shown in FIG. 2 and FIG. 3, each of the terminals 2 is made of a metal sheet. Each of the terminals 2 includes a base 21, an elastic arm 22, a through slot 23, an engaging portion 24, a strip connecting portion 25, a position limiting portion 26 and a conducting portion 27.

As shown in FIG. 2 and FIG. 6, the base 21 is in the shape of a flat plate. The base 21 is accommodated in the corresponding accommodating hole 13, and the base 21 is positioned behind the rear end 162 and is parallel to the rear end 162.

The elastic arm 22 is formed by bending and extending upward and forward from the top end of the base 21. The elastic arm 22 extends upward beyond the accommodating hole 13 and is used to be electrically connected with the chip module 200, and the elastic arm 22 is located at one side of the protruding block 16. In this embodiment, the elastic arm 22 is located at the right side of the corresponding protruding block 16. The through slot 23 extends through the elastic arm 22 in the vertical direction Z.

As shown in FIG. 2, FIG. 3 and FIG. 6, the elastic arm 22 includes a first arm 221 formed by extending upward from the base 21. In this embodiment, the first arm 221 is formed by tilting upward and slightly forward from the plane where the base 21 is located. A second arm 222 is formed by bending and extending upward and forward from the first arm 221. In this embodiment, the second arm 222 extends forward beyond the front end 161 from behind the rear end 162, and a width of the second arm 222 gradually decreases in the extending direction thereof. Further, a contact portion 223 is formed by bending and extending upward and forward from the second arm 222, and the contact portion 223 is used for abutting the chip module 200. The through slot 23 extends on the first arm 221 and the second arm 222, and a gap is formed between the through slot 23 and the base 21. The through slot 23 does not run forward through the second arm 222. The through slot 23 is provided not to have an identical width in the extending direction thereof (referring to FIG. 9). The through slot 23 is provided with an arc-shaped front edge 231, and a gap is formed between the front edge 231 and the contact portion 223. The front edge 231 is located between the front end 161 and the rear end 162, i.e., the through slot 23 extends forward beyond the rear end 162. As shown in FIG. 7, the contact portion 223 is arc-shaped and defines a center P of a circle. A lowest point of a tail end of the contact portion 223 is located below the center P of the circle, and the lowest point of the tail end of the contact portion 223 is located above the through slot 23. As shown in FIG. 6, a width W3 of a connecting portion connecting the first arm 221 to the second arm 222 is greater than a width W4 of a connecting portion connecting the second arm 222 to the contact portion 223, thereby increasing the elasticity of the elastic arm 22.

As shown in FIG. 3 and FIG. 6, the engaging portion 24 is formed by bending and extending forward from one side of the base 21 and is perpendicular to the base 21. The engaging portion 24 is accommodated in the accommodating hole 13 and forms an interference fit with the second wall surface 132, and the engaging portion 24 is located behind the rear end 162 and is perpendicular to the rear end 162. In other embodiments, the engaging portion 24 may also extend forward beyond the rear end 162 and be located behind the front end 161.

As shown in FIG. 3 and FIG. 6, the strip connecting portion 25 is formed by extending vertically upward from the top end of the engaging portion 24. The strip connecting portion 25 and the engaging portion 24 are on the same plane, and the strip connecting portion 25 is used to be connected with a strip 3. A gap is formed between the strip connecting portion 25 and the elastic arm 22, and the strip connecting portion 25 is located behind the rear end 162 and is perpendicular to the rear end 162. In other embodiments, the strip connecting portion 25 may also extend forward beyond the rear end 162 and be located behind the front end 161.

As shown in FIG. 2, FIG. 6 and FIG. 9, the position limiting portion 26 is formed by extending outward from the other side of the base 21. The position limiting portion 26 and the base 21 are on the same plane. The position limiting portion 26 is accommodated in the accommodating groove 15. The position limiting surface 151 is located below the position limiting portion 26 and used for limiting the terminal 2 from moving downward, and the protruding block 16 and the position limiting portion 26 are respectively located at the left side and right side of the through slot 23.

As shown in FIG. 2, the conducting portion 27 is formed by extending downward from the bottom end of the base 21 and used for conducting the circuit board 300. The conducting portion 27 includes an extending portion 271, a stopping portion 272 and a bending portion 273.

As shown in FIG. 2 and FIG. 7, the extending portion 271 is formed by extending downward from the bottom end of the base 21, and the extending portion 271 tilts and extends toward the stop block 18.

As shown in FIG. 2 and FIG. 9, the stopping portion 272 is formed by extending from one side of the extending portion 271. The stopping portion 272 and the extending portion 271 are on the same plane, and the stopping block 14 is located right above the stopping portion 272 and used for limiting the terminal 2 from moving upward.

As shown in FIG. 2 and FIG. 4, the bending portion 273 is formed by bending and extending forward from the other side of the extending portion 271. The extending portion 271 and the bending portion 273 are in contact with a solder material 4, and the two position limiting blocks 18 stop the solder material 4, such that the solder material 4 is accommodated in the space defined by the extending portion 271, the bending portion 273 and the position limiting blocks 18. In this embodiment, the extending portion 271, the bending portion 273 and the two position limiting blocks 18 hold the solder material 4 together so as to solder the terminal 2 to the circuit board 300, and the solder material 4 is a solder ball.

As shown in FIG. 9, a gap is formed between the position limiting portion 26 and the position limiting surface 151, and a gap is formed between the stopping block 14 and the stopping portion 272. When the terminals 2 are soldered to the circuit board 300 and are pulled due to the influence of the soldering, the terminals 2 can move in the accommodating holes 13 along the vertical direction Z. Thus, the heights of the terminals 2 can be adjusted to ensure the coplanarity of the terminals 2, thereby avoiding empty soldering in the soldering process of the terminals 2.

In the assembly process of the electrical connector 100, as shown in FIG. 2, the terminals 2 are respectively installed downward into the accommodating holes 13, as shown in FIG. 6 and FIG. 9, until the engaging portion 24 and the second wall surface 132 form an interference fit and the stopping portion 272 is positioned right below the stopping block 14. At this time, the through slot 23 extends forward beyond the rear end 162 of the corresponding protruding block 16, the front edge 231 is located between the front end 161 and the rear end 162, and the protruding block 16 arranged corresponding to the left side of another accommodating hole 13 is also arranged near the right side of the elastic arm 22 of some of the terminals 2. As shown in FIG. 4, the solder materials 4 are respectively installed upward and clamped between the conducting portion 27 and the two position limiting blocks 18.

When the electrical connector 100 is in use, as shown in FIG. 7 and FIG. 8, the electrical connector 100 is firstly installed on the circuit board 300, and the electrical connector 100 is soldered and fixed to the circuit board 300 by the solder materials 4. Then the chip module 200 is installed to the electrical connector 100, and a downward acting force is applied to the chip module 200 such that the chip module 200 downward abuts the terminals 2, until the chip module 200 completely presses the elastic arm 22. At this time, the chip module 200 downward abuts the protruding blocks 16 and the protruding portions 17, and the through slot 23 extends forward beyond the front end 161 of the corresponding protruding block 16, i.e., the front edge 231 is located in front of the front end 161. As shown in FIG. 2 and FIG. 6, since one of the protruding blocks 16 is provided at each of the left and right sides of the elastic arm 22, when the elastic arm 22 is deflected by an external force in the left-right direction Y, the elastic arm 22 can laterally abut one of the protruding blocks 16, thereby avoiding deformation failure of the elastic arm 22 due to excess deflection, and avoiding short circuiting caused by the contact between the adjacent elastic arms 22.

FIG. 10 to FIG. 14 show an electrical connector 100 according to the second embodiment of the present invention. In this embodiment, the structures labeled with the same reference symbols as those in the first embodiment are not elaborated repeatedly. Compared with the electrical connector 100 according to the first embodiment, the electrical connector 100 in this embodiment mainly has the following differences:

The front end 161 is flush with the second wall surface 132 of the corresponding accommodating hole 13, and the rear end 162 is located between the first wall surface 131 and the second wall surface 132.

One protruding portion 17 is provided, and the protruding portion 17 is protrudingly provided on the upper surface 11 to form a fence, which is surroundingly provided at the periphery of the accommodating holes 13.

One of the protruding blocks 16 is provided at each of the left and right sides of some of the elastic arms 22, and the through slot 23 runs forward beyond the front end 161 of the protruding blocks 16 on the left and right sides at the same time. When the elastic arm 22 is deflected in the left-right direction Y by an external force, the elastic arm 22 can laterally abut one of the protruding blocks 16, thereby avoiding deformation failure of the elastic arm 22 due to excess deflection, and avoiding short circuiting caused by the contact between the adjacent elastic arms 22.

The base 21 has a vertical plane 211. The first arm 221 is formed by bending and extending upward from the base 21 in a direction away from the vertical plane 211, and the second arm 222 is formed by bending and extending reversely from the first arm 221 to pass beyond the vertical plane 211, thereby increasing the elasticity of the elastic arm 22.

The through slot 23 runs vertically through the second arm 222, and extends downward to a bending location of the second arm 222 and the first arm 221.

The through slot 23 extends forward to the contact portion 223 so as to divide the contact portion 223 into two portions, such that the two contact portions 223 of the same terminal 2 simultaneously abut the same pad of the chip module 200, and the through slot 23 extends forward beyond the front end 161, i.e., the front edge 231 is located in front of the front end 161.

Two strip connecting portions 25 are provided, and are located at the left and right sides of the elastic arm 22, and the strip connecting portions 25 are formed by vertically extending upward from the base 21.

Two bending portions 273 are provided, and are formed by bending and extending from the left and right sides of the extending portion 271. The two bending portions 273 and the extending portion 271 hold the solder material 4 together, and the bending portions 273 and the solder material 4 are respectively at least partially accommodated in the accommodating hole 13.

In sum, the electrical connector according to certain embodiments of the present invention has the following beneficial effects:

(1) The through slot 23 runs vertically through the elastic arm 22 and extends forward beyond the rear end 162 of the protruding block 16, such that the arrangement of the through slot 23 can effectively increase the elasticity of the elastic arm 22 on the premise of ensuring that a length of the elastic arm 22 is unchanged, thereby ensuring the stable contact between the elastic arm 22 and the chip module 200 and satisfying the demand of thinning of the electrical connector 100. When the chip module 200 downward abuts the elastic arm 22, the elastic arm 22 can form two parallel conductive paths at two opposite sides of the through slot 23, thereby enhancing the high-frequency signal transmitting capacity of the terminal 2.

(2) The through slot 23 extends forward to the contact portion 223 so as to further increase the length of the through slot 23 in the elastic arm 22, thereby increasing the elasticity of the elastic arm 22, lowering the self-inductance of the elastic arm 22, and reducing the cross talk between the adjacent terminals 2.

(3) One of the protruding blocks 16 is provided at each of the left and right sides of the elastic arm 22. When the elastic arm 22 is deflected in the left-right direction Y by an external force, the elastic arm 22 can laterally abut one of the protruding blocks 16, thereby avoiding deformation failure of the elastic arm 22 due to excess deflection, and avoiding short circuiting caused by the contact between the adjacent elastic arms 22.

(4) The lowest point of the tail end of the contact portion 223 is located below the center P of the circle, thereby lowering the risk that the contact portion 223 is scraped by external elements.

(5) The width W1 of the rear end 162 in the left-right direction Y is less than the width W2 of the front end 161 in the left-right direction Y. The second arm 222 extends forward beyond the front end 161 from behind the rear end 162, and the width of the second arm 222 gradually decreases in the extending direction. Under such structural design of the protruding block 16, the strength of the protruding block 16 can be increased, and the protruding block 16 can give way to the second arm 222.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect to a chip module, comprising:

a body, provided with at least one accommodating hole, wherein the body has a protruding block provided to protrude upward from one side of the accommodating hole, and the protruding block is configured to support the chip module upward; and at least one terminal, correspondingly accommodated in the at least one accommodating hole, wherein the terminal comprises:

a base, accommodated in the accommodating hole;

an elastic arm, formed by extending upward from the base and located at one side of the protruding block, wherein the elastic arm has a contact portion located in front of the base and configured to be electrically connected with the chip module; and a through slot, running vertically through the elastic arm, wherein the through slot has a front edge located in front of the base, the protruding block has a rear end, the base is located behind the rear end, and the through slot extends forward beyond the rear end.

2. The electrical connector according to claim 1, wherein the through slot is provided not to have an identical width in an extending direction thereof.

3. The electrical connector according to claim 1, wherein the body is provided with a plurality of accommodating holes and a plurality of protruding blocks, one side of each of the accommodating holes is provided with one of the protruding blocks, the protruding block is located between the two adjacent accommodating holes, the protruding block has a front end provided to be opposite to the rear end, and the front end is flush with another side of one of the accommodating holes.

4. The electrical connector according to claim 1, wherein the body is provided with a plurality of accommodating holes and a plurality of protruding blocks, one side of each of the accommodating holes is provided with one of the protruding blocks, each of a left side and a right side of the elastic arm is respectively provided with one of the protruding blocks, and when the elastic arm is deflected by an external force in a left-right direction, the elastic arm laterally abuts one of the protruding blocks.

5. The electrical connector according to claim 1, wherein the protruding block has a front end provided to be opposite to the rear end, and the front edge is located between the front end and the rear end.

6. The electrical connector according to claim 5, wherein when the chip module completely presses the elastic arm, the chip module downward abuts the protruding block, and the front edge is located forward beyond the front end.

7. The electrical connector according to claim 1, wherein the terminal comprises an engaging portion formed by bending and extending from one side of the base, the protruding block has a front end provided to be opposite to the rear end, and the engaging portion is accommodated in the accommodating hole and located behind the front end.

8. The electrical connector according to claim 7, wherein the engaging portion is located behind the rear end.

9. The electrical connector according to claim 7, wherein the engaging portion is perpendicular to the base and forms an interference fit with an inner wall surface of the accommodating hole.

10. The electrical connector according to claim 7, wherein the terminal comprises a strip connecting portion formed by extending upward from the engaging portion, and the strip connecting portion is configured to be connected with a strip and located behind the rear end.

11. The electrical connector according to claim 1, wherein the terminal comprises a position limiting portion formed by extending outward from the base, the accommodating hole is provided with a position limiting surface located below the position limiting portion and configured to limit the terminal from moving downward, and the position limiting portion and the protruding block are located respectively at a left side and a right side of the through slot.

12. The electrical connector according to claim 1, wherein the terminal comprises a conducting portion formed by extending downward from the base, the conducting portion is configured to be conductively connected to a circuit board, the conducting portion comprises an extending portion formed by extending downward from the base and a stopping portion formed by extending from one side of the extending portion, and an inner wall surface of the accommodating hole is protrudingly provided with a stopping block located above the stopping portion and configured to limit the terminal from moving upward.

13. The electrical connector according to claim 1, wherein the terminal comprises a conducting portion extending downward from the base, the conducting portion is configured to be conductively connected to a circuit board, the conducting portion comprises an extending portion formed by extending downward from the base and a bending portion formed by bending and extending from one side of the extending portion, the body is provided with a position limiting block at another side of the accommodating hole, the extending portion and the bending portion are in contact with a solder material, and the position limiting block limits a position of the solder material, such that the solder material is accommodated in a space defined by the extending portion, the bending portion and the position limiting block.

14. The electrical connector according to claim 1, wherein the contact portion is located at a tail end of the elastic arm, and a lowest point of the contact portion is located above the through slot.

15. The electrical connector according to claim 14, wherein the contact portion is arc-shaped and defines a center of a circle, and the lowest point of the tail end of the contact portion is located below the center of the circle.

16. The electrical connector according to claim 1, wherein the elastic arm comprises a first arm formed by extending upward from the base, and a second arm formed by bending and extending upward and forward from the first arm; and wherein the contact portion is formed by bending and extending upward and forward from the second arm, and a width of a connecting portion connecting the first arm to the second arm is greater than a width of a connecting portion connecting the second arm to the contact portion.

17. The electrical connector according to claim 16, wherein the through slot runs vertically through the second arm, and at least extends downward to the connecting portion connecting the first arm to the second arm.

18. The electrical connector according to claim 17, wherein the base has a vertical plane, the first arm is formed by bending and extending upward from the base in a direction away from the vertical plane, and the second arm is formed by bending and extending reversely from the first arm to pass beyond the vertical plane.

19. The electrical connector according to claim 16, wherein the protruding block has a front end provided to be opposite to the rear end, a width of the rear end in a left-right direction is less than a width of the front end in the left-right direction, the second arm extends forward beyond the front end from behind the rear end, and a width of the second arm gradually decreases in an extending direction thereof.

20. The electrical connector according to claim 1, wherein the through slot does not run forward through an extended tail end of the elastic arm.

21. The electrical connector according to claim 1, wherein the contact portion is located at a tail end of the elastic arm, and the through slot extends forward to the contact portion.

* * * * *